US011680748B2

(12) United States Patent
Ichikawa et al.

(10) Patent No.: US 11,680,748 B2
(45) Date of Patent: Jun. 20, 2023

(54) METHOD FOR CHARGING RAW MATERIALS INTO BLAST FURNACE

(71) Applicant: JFE Steel Corporation, Tokyo (JP)

(72) Inventors: Kazuhira Ichikawa, Tokyo (JP); Yasushi Ogasawara, Tokyo (JP); Takeshi Sato, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 295 days.

(21) Appl. No.: 17/042,392

(22) PCT Filed: Mar. 4, 2019

(86) PCT No.: PCT/JP2019/008261
§ 371 (c)(1),
(2) Date: Sep. 28, 2020

(87) PCT Pub. No.: WO2019/187997
PCT Pub. Date: Oct. 3, 2019

(65) Prior Publication Data

US 2021/0033339 A1 Feb. 4, 2021

(30) Foreign Application Priority Data

Mar. 30, 2018 (JP) ..... JP2018-066458

(51) Int. Cl.
*F27B 1/20* (2006.01)
*C21B 7/20* (2006.01)
*F27D 3/10* (2006.01)

(52) U.S. Cl.
CPC ..... *F27B 1/20* (2013.01); *C21B 7/20* (2013.01); *F27D 3/10* (2013.01)

(58) Field of Classification Search
CPC ..... F27B 1/20; F27D 3/10; C21B 7/20; C21B 5/00; C21B 5/008

(Continued)

(56) References Cited

U.S. PATENT DOCUMENTS 8,092,136 B2 * 1/2012 Lonardi ..... F27D 3/0032 414/206
2009/0087284 A1 * 4/2009 Lonardi ..... F27D 3/0032 414/206

FOREIGN PATENT DOCUMENTS

CN 1596315 A 3/2005
CN 107614707 A 1/2018

(Continued)

OTHER PUBLICATIONS

Chinese Office Action for Chinese Application No. 201980023639.2, dated Feb. 28, 2022, with Concise Statement of Relevance of Office Action, 5 pages.

(Continued)

*Primary Examiner* — Scott R Kastler
*Assistant Examiner* — Michael Aboagye
(74) *Attorney, Agent, or Firm* — RatnerPrestia

(57) ABSTRACT

A method for charging raw materials into a blast furnace is provided. The blast furnace includes a bell-less charging device that includes a plurality of main hoppers and an auxiliary hopper. The auxiliary hopper has a smaller capacity than the main hoppers. The method includes discharging ore charged in at least one of the plurality of main hoppers and then sequentially charging the ore from a furnace center side toward a furnace wall side by using a rotating chute. After charging of the ore is started, only the ore is charged from the rotating chute at least until charging of 15 mass % of the ore is completed based on a total amount of the ore to be charged per batch; then discharging of small-size coke charged in the auxiliary hopper is started; and then, the small-size coke is charged together with the ore from the rotating chute.

20 Claims, 9 Drawing Sheets

(58) Field of Classification Search
USPC ..... 266/197, 183, 176, 199; 414/804, 206, 414/204, 205, 195, 199
See application file for complete search history.

(56) References Cited

FOREIGN PATENT DOCUMENTS

| | | | | | |
|---|---|---|---|---|---|
| EP | 1445334 | A1 | | 8/2004 | |
| EP | 2851435 | A1 | | 3/2015 | |
| JP | 52043169 | B2 | | 10/1977 | |
| JP | 57207105 | A | | 12/1982 | |
| JP | 5941402 | A | | 3/1984 | |
| JP | 60208404 | A | | 10/1985 | |
| JP | 02236210 | A | | 9/1990 | |
| JP | 03211210 | A | | 9/1991 | |
| JP | 07268411 | A | | 10/1995 | |
| JP | 0987710 | A | | 3/1997 | |
| JP | 2004010980 | | * | 1/2004 | ..... F27B 1/20 |
| JP | 2004010980 | A | | 1/2004 | |
| JP | 2004107794 | A | | 4/2004 | |
| JP | 2005290511 | A | | 10/2005 | |
| JP | 3948352 82 | | | 7/2007 | |
| JP | WO2012164889 | | * | 2/2015 | ..... F27B 1/20 |
| JP | 2015117388 | A | | 6/2015 | |
| WO | 2013172043 | A1 | | 11/2013 | |
| WO | 2013172045 | A1 | | 11/2013 | |
| WO | 2016125487 | A1 | | 8/2016 | |
| WO | 2016190155 | A1 | | 12/2016 | |

OTHER PUBLICATIONS

Korean Office Action for Korean Application No. 10-2020-7028209, dated Mar. 9, 2022, with Concise Statement of Relevance of Office Action, 7 pages.
International Search Report and Written Opinion for International Application No. PCT/JP2019/008261, dated Apr. 23, 2019, with partial translation, 5 pages.
Extended European Search Report for European Application No. 19 776 073.9, dated Apr. 9, 2021, 7 pages.
Hu, J. et al., "New Development of Technology for Increasing Coke Mixed Charging Ratio in Blast Furnace," Mar. 2013, vol. 35(2), 18 pages, Shanghai Metals (with English translation).
Chinese Office Action with Search Repod for Chinese Application No. 201980023639.2, dated Sep. 28, 2021, 11 pages.
Shimizu et al., A Basic Study of the Control of a Coke in Deadman of a Blast Furnace (Development of Blast Furnace Operation Technology By Coke Center Charging—1), The Iron and Steel Institute of Japan, 1987, vol. 73, 3 pages.

* cited by examiner

METHOD FOR CHARGING RAW MATERIALS INTO BLAST FURNACE

CROSS REFERENCE TO RELATED APPLICATIONS

This is the U.S. National Phase application of PCT/JP2019/008261, filed Mar. 4, 2019, which claims priority to Japanese Patent Application No. 2018-066458, filed Mar. 30, 2018, the disclosures of these applications being incorporated herein by reference in their entireties for all purposes.

FIELD OF THE INVENTION

The present invention relates to a method for charging raw materials into a blast furnace that includes a bell-less-type charging device.

BACKGROUND OF THE INVENTION

In recent years, there has been a demand for reducing $CO_2$ emissions for the prevention of global warming. In the steel industry, approximately 70% of the amount of $CO_2$ emission is associated with blast furnaces, and, therefore, there is a demand for reducing the amount of $CO_2$ emission associated with blast furnaces. Reducing $CO_2$ emission associated with blast furnaces can be achieved by reducing reduction agents used in blast furnaces, such as coke, pulverized coal, and natural gas.

However, reducing a reduction agent, particularly coke, which serves to ensure the gas permeability of the burden layer in a furnace, results in an increase in the gas permeation resistance of the burden layer of the furnace. In a common blast furnace, when the ore charged from the furnace top reaches a temperature at which the ore begins to soften, the ore is deformed while filling voids; this occurs because of the weight of the raw materials existing in an upper region. As a result, in a lower region of the blast furnace, a cohesive zone is formed in which the gas permeation resistance of an ore layer is very high, and thus little gas flows. The gas permeability of the cohesive zone has a significant influence over the gas permeability of the entire blast furnace and, therefore, limits the productivity of the blast furnace.

In the related art, many studies have been conducted to improve the gas permeation resistance of the cohesive zone. For instance, mixing coke into an ore layer is known to be effective. As one example, Patent Literature 1 discloses a method for uniformly mixing coke with ore in a bell-less-type blast furnace. In the method, coke is charged into some of the ore hoppers, the some ore hoppers being downstream hoppers, to deposit the coke on ore on a conveyor, the resultant is then charged into a furnace top hopper, and the ore and the coke are then charged into the blast furnace via a rotating chute. Patent Literature 2 discloses a method for performing center charging of coke and mixed charging of ore and coke smoothly in a steady manner. In the method, ore and coke are separately stored in hoppers on the furnace top, and simultaneous mixed charging of the coke and the ore is performed.

Studying of methods and apparatuses for charging raw materials into a blast furnace is important for producing an effect of uniformly mixing coke with ore. Accordingly, many studies have been conducted in the related art. Patent Literature 3 discloses a method for charging raw materials. In the method, raw materials are supplied from an auxiliary supply passage to a raw material main supply passage that connects a blast furnace raw material storage hopper to a distribution chute. Patent Literature 3 discloses an embodiment in which an auxiliary raw material is sequentially mixed with a main raw material and supplied into the furnace in conjunction with the time at which the main raw material is charged.

Patent Literature 4 discloses a method for charging raw materials into a blast furnace. In the method, a plurality of raw materials is simultaneously charged from a plurality of main hoppers. However, when the raw materials are to be charged into a blast furnace, a pressure adjustment time is necessary for replacing the atmosphere within the main hoppers with an atmosphere corresponding to the blast furnace interior atmosphere. From the standpoint of maintaining a production volume, using a hopper exclusively for a small amount of raw material is not practical.

Patent Literature 5 discloses a method in which a small-size second hopper for charging a small amount of raw material is provided in addition to ordinary hoppers (first hoppers), and a raw material is charged from the second hopper either during intervals between the operations of charging a main raw material from the first hoppers or simultaneously with the charging of the main raw material, depending on the type of the raw material. According to Patent Literature 5, poor-quality ore is stored at a predetermined level within the first hoppers used to store ore, which is a main raw material, and when the ores are charged into a blast furnace, undersize coke is discharged from the second hopper in conjunction with the time at which the ores that are discharged from the first hoppers are charged into the furnace based on the funnel flow discharge characteristics; accordingly, the mixing of the poor-quality ore with the undersize coke is facilitated. As described above, regarding a hopper provided at an upper portion of a blast furnace, a pressure adjustment time is necessary for replacing the atmosphere within the hopper with an air atmosphere when raw materials are to be stored in the hopper and for replacing the atmosphere within the hopper with an atmosphere corresponding to the blast furnace interior atmosphere when the raw materials are to be discharged into the blast furnace. Accordingly, using a hopper exclusively for a small amount of raw material is not practical from the standpoint of maintaining a production volume. According to Patent Literature 5, the second hopper disclosed is provided to solve the problem, and a small amount of raw material can be charged independently, which enables effective use of a small amount of raw material.

Patent Literature

PTL 1: Japanese Unexamined Patent Application Publication No. 3-211210
PTL 2: Japanese Unexamined Patent Application Publication No. 2004-107794
PTL 3: Japanese Unexamined Patent Application Publication No. 57-207105
PTL 4: International Publication No. 2013/172045
PTL 5: Japanese Patent No. 3948352

Non Patent Literature

NPL 1: Shimizu et al., "A basic study of the control of a coke in deadman of a blast furnace", Tetsu-To-Hagane, The Iron and Steel Institute of Japan, 1987, vol. 73, 5754

SUMMARY OF THE INVENTION

As described above, effectively charging a small amount of raw material, such as small-size coke, into a blast furnace improves the gas permeability of the burden layer in the furnace and is, therefore, effective for lowering a reduction agent rate of the blast furnace. On the other hand, such small amount of raw materials and main raw materials, such as ore, differ in density and particle diameter, and, therefore, segregation occurs, and control thereof is required. To address this, countermeasures have been studied. An example of the countermeasures is charging raw materials into a blast furnace in such a manner that different types of raw materials are simultaneously charged from a plurality of hoppers, as disclosed in Patent Literature 3 and Patent Literature 5, described above.

However, it is known that when a raw material having a small particle diameter, such as small-size coke, is charged into a central portion of a furnace, the raw material exhibits a high resistance to the flow of gas flowing in the central portion of the furnace and, therefore, becomes a factor that interferes with the formation of a stable central gas flow. As reported in Non Patent Literature 1, coke charged into a region defined by a blast furnace dimensionless radius of 0.12 or less reaches a deadman, which is formed below the cohesive zone. The coke in deadman is not combusted with oxygen supplied through the tuyeres of the blast furnace and, therefore, remains within the furnace for a long time period. Accordingly, if the coke in deadman has a small particle diameter, the coke in deadman becomes a factor that causes deterioration or instability of the gas permeability of the burden layer in the furnace over a long time period.

Such a problem cannot be solved only by charging raw materials into a blast furnace in such a manner that different types of raw materials are simultaneously charged from a plurality of hoppers, as disclosed in Patent Literature 3 and Patent Literature 5.

An object according to aspects of the present invention is to provide methods for charging raw materials into a blast furnace, the methods being designed to solve problems associated with the related art technologies, such as the problems described above. Specifically, for a blast furnace including a bell-less-type charging device and regarding the formation of a mixture layer of small-size coke and ore in the furnace, the methods promote the reduction reaction of the ore while preventing a particle size reduction of coke in deadman, thereby inhibiting deterioration of the gas permeability of the burden layer in the blast furnace and improving the reducibility thereof.

A summary of aspects of the present invention, which solve the problems described above, is as follows.

[1] A method for charging raw materials into a blast furnace, the blast furnace including a bell-less charging device that includes a plurality of main hoppers and an auxiliary hopper at a furnace top portion, the auxiliary hopper having a smaller capacity than the main hoppers, the method including discharging ore charged in at least one of the plurality of main hoppers and then sequentially charging the ore from a furnace center side toward a furnace wall side by using a rotating chute, wherein after charging of the ore is started, only the ore is charged from the rotating chute at least until charging of 15 mass % of the ore is completed based on a total amount of the ore to be charged per batch; then, at a point in time, discharging of small-size coke charged in the auxiliary hopper is started; and then, the small-size coke is charged together with the ore from the rotating chute for a time period.

[2] The method for charging raw materials into a blast furnace according to [1], wherein the small-size coke charged in the auxiliary hopper is an amount of the small-size coke for a plurality of charges, and an amount of the small-size coke per charge is discharged in batches from the auxiliary hopper.

[3] A method for charging raw materials into a blast furnace, the blast furnace including a bell-less charging device that includes a plurality of main hoppers and an auxiliary hopper at a furnace top portion, the auxiliary hopper having a smaller capacity than the main hoppers, the method including discharging ore charged in at least one of the plurality of main hoppers and then sequentially charging the ore from a furnace wall side toward a furnace center side by using a rotating chute, wherein discharging of small-size coke charged in the auxiliary hopper is started simultaneously with a start of charging of the ore or at a point in time after the start of the charging, and then the small-size coke is charged together with the ore from the rotating chute; and charging of the small-size coke is stopped at least before a point in time at which charging of 90 mass % of the ore is completed based on a total amount of the ore to be charged per batch.

[4] The method for charging raw materials into a blast furnace according to [3], wherein the small-size coke charged in the auxiliary hopper is an amount of the small-size coke for a plurality of charges, and an amount of the small-size coke per charge is discharged in batches from the auxiliary hopper.

[5] The method for charging raw materials into a blast furnace according to [1] or [2], wherein, for a portion or all of a time period from a point in time at which charging of 27 mass % of the ore is completed to a point in time at which charging of 46 mass % of the ore is completed, based on the total amount of the ore to be charged per batch, a rate of discharge of the small-size coke to be discharged from the auxiliary hopper is increased compared with a rate of discharge employed for a different time period.

[6] The method for charging raw materials into a blast furnace according to [5], wherein, for a portion or all of the time period from the point in time at which charging of 27 mass % of the ore is completed to the point in time at which charging of 46 mass % of the ore is completed, based on the total amount of the ore to be charged per batch, the rate of discharge of the small-size coke to be discharged from the auxiliary hopper is set to be 1.5 to 2 times the rate of discharge employed for a different time period.

[7] The method for charging raw materials into a blast furnace according to [3] or [4], wherein, for a portion or all of a time period from a point in time at which charging of 54 mass % of the ore is completed to a point in time at which charging of 83 mass % of the ore is completed, based on the total amount of the ore to be charged per batch, a rate of discharge of the small-size coke to be discharged from the auxiliary hopper is increased compared with a rate of discharge employed for a different time period.

[8] The method for charging raw materials into a blast furnace according to [7], wherein, for a portion or all of the time period from the point in time at which charging of 54 mass % of the ore is completed to the point in time at which charging of 83 mass % of the ore is completed, based on the total amount of the ore to be charged per batch, the rate of discharge of the small-size coke to be discharged from the auxiliary hopper is set to be 1.5 to 2 times the rate of discharge employed for a different time period.

[9] The method for charging raw materials into a blast furnace according to any one of [1] to [4], wherein a gas composition distribution in a furnace radial direction within the blast furnace is measured to determine a distribution of a CO gas utilization ratio associated with the furnace radial direction, and, for a region in the furnace radial direction in which the CO gas utilization ratio is greater than or equal to an average value of the CO gas utilization ratio associated with the furnace radial direction, a rate of discharge of the small-size coke to be discharged from the auxiliary hopper is increased compared with a rate of discharge employed for a different region in the furnace radial direction.

[10] The method for charging raw materials into a blast furnace according to [9], wherein the gas composition distribution in the furnace radial direction within the blast furnace is measured to determine the distribution of the CO gas utilization ratio associated with the furnace radial direction, and, for the region in the furnace radial direction in which the CO gas utilization ratio is greater than or equal to the average value of the CO gas utilization ratio associated with the furnace radial direction, the rate of discharge of the small-size coke to be discharged from the auxiliary hopper is set to be 1.5 to 2 times the rate of discharge employed for a different region in the furnace radial direction.

[11] The method for charging raw materials into a blast furnace according to any one of [1] to [10], wherein the auxiliary hopper has a hopper body and an outlet, and the auxiliary hopper is provided at a position such that central axes of the hopper body and the outlet coincide with a central axis of a furnace body of the blast furnace.

In accordance with aspects of the present invention, a mixture layer of small-size coke and ore can be formed to have an appropriate state in a furnace, which makes it possible to inhibit a particle size reduction of coke in deadman and an associated deterioration of gas permeability in a furnace central portion while promoting the reduction reaction of ore and, therefore, improving reducibility.

DETAILED DESCRIPTION OF EMBODIMENTS OF THE INVENTION

Figure 1:
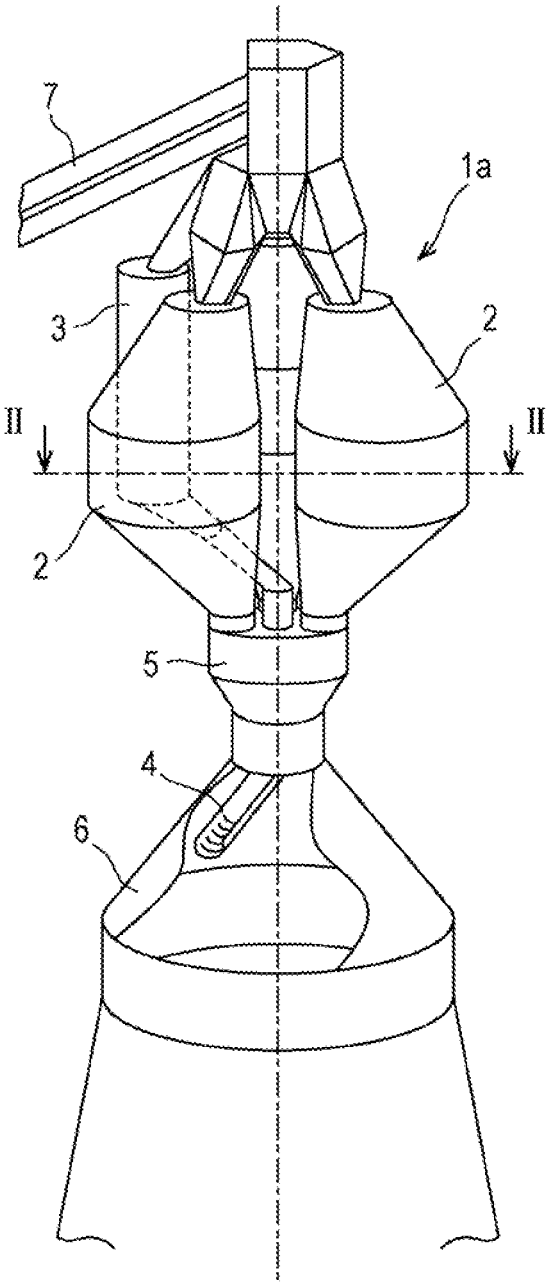
FIG. 1 is an overall perspective view of a bell-less charging device 1*a*, which is a cutaway view of a portion on top of a furnace body.

Mixing small-size coke into ore layers is effective for improving the gas permeability of the burden layer in a furnace. In this case, however, it is necessary to prevent deterioration of the furnace conditions that may be caused by small-size coke remaining in a deadman portion. Since small-size coke mixed with ore serves to promote a reaction of the ore, it is desirable that a region having a large ore layer thickness have an increased coke mixing ratio, as will be described later. Accordingly, in a case where small-size coke is to be mixed into an ore layer, it is desirable that the small-size coke be charged into the furnace in a manner that satisfies the conditions mentioned above.

In a case where a raw material charging device of the related art is used, small-size coke is to be mixed with ore in a main hopper in advance and thereafter discharged into a blast furnace. In this case, at an initial stage of raw material charging, only ore is charged into the main hopper, and subsequently, raw materials including small-size coke are charged into the main hopper, to prevent the small-size coke from being discharged at an initial stage of discharging. However, in the main hopper, segregation occurs due to a difference in density between the ore and the small-size coke. In addition, since the raw materials are discharged from the main hopper in a funnel flow, the raw materials that are discharged has a small-size coke mixing ratio different from the small-size coke mixing ratio at the time when the small-size coke is charged into the main hopper. Consequently, controlling the small-size coke in a manner such that a preferred mixed state, such as that described above, is achieved is difficult.

In accordance with aspects of the present invention, a bell-less charging device including a plurality of main hoppers and an auxiliary hopper at a furnace top portion is used. The auxiliary hopper has a smaller capacity than the main hoppers. Ore is charged into at least one of the plurality of main hoppers, and an amount of small-size coke for a plurality of charges is charged into the auxiliary hopper. An amount of the ore per charge is discharged in batches from the main hoppers, and an amount of the small-size coke per charge is discharged in batches from the auxiliary hopper. In such raw material charging, a ratio of mixing of the small-size coke can be varied by adjusting the amounts of the raw materials to be discharged from the main hopper and the auxiliary hopper, and, therefore, the small-size coke can be easily controlled in a manner such that a preferred mixed state is achieved.

In accordance with aspects of the present invention, the term "small-size coke" refers to lumps of coke having small particle diameters, which are separated by sieving when lumps of coke to be used in a blast furnace are obtained from coke produced in a chamber-type coke furnace. Typically, the small-size coke has an average particle diameter (D50) of approximately 5 to 25 mm.

In accordance with aspects of the present invention, the term "ore" refers to one or more of sintered ore, lump ore, pellets, and the like, which are iron sources. In a case where one or more auxiliary raw materials (e.g., limestone, silica stone, serpentinite, and the like), which are used mainly for the purpose of slag component adjustment, are mixed with the ore, the ore includes such auxiliary raw materials.

In an operation of a blast furnace, raw materials are charged from a furnace top portion in a manner such that ore layers and coke layers are alternately formed within the blast furnace. In a case where small-size coke is to be mixed into an ore layer, an amount of ore to be used and an amount of small-size coke to be used to form one such ore layer are referred to as an amount of ore per charge and an amount of small-size coke per charge. The amount of ore per charge and the amount of small-size coke per charge are to be charged in batches. According to aspects of the present invention, methods for charging raw materials into a blast furnace are concerned with methods for charging ore and small-size coke that are charged on a per-batch basis.

If the particle diameter of the raw materials that are charged on a per-batch basis varies, the gas flow within the furnace may become unstable. Accordingly, it is preferable to ensure that the downward flow of the raw materials within the auxiliary hopper is a mass flow, thereby enabling the raw materials charged in the auxiliary hopper to be discharged from the auxiliary hopper in the order in which the raw materials are charged. It is preferable that a diameter d2 of a hopper body of the auxiliary hopper satisfy $d1<d2\leq1.5\times d1$, where d1 is a diameter of an outlet of the auxiliary hopper, and d2 is the diameter of the hopper body. This configuration ensures that the downward flow of the raw materials within the auxiliary hopper is a mass flow.

Figure 2:
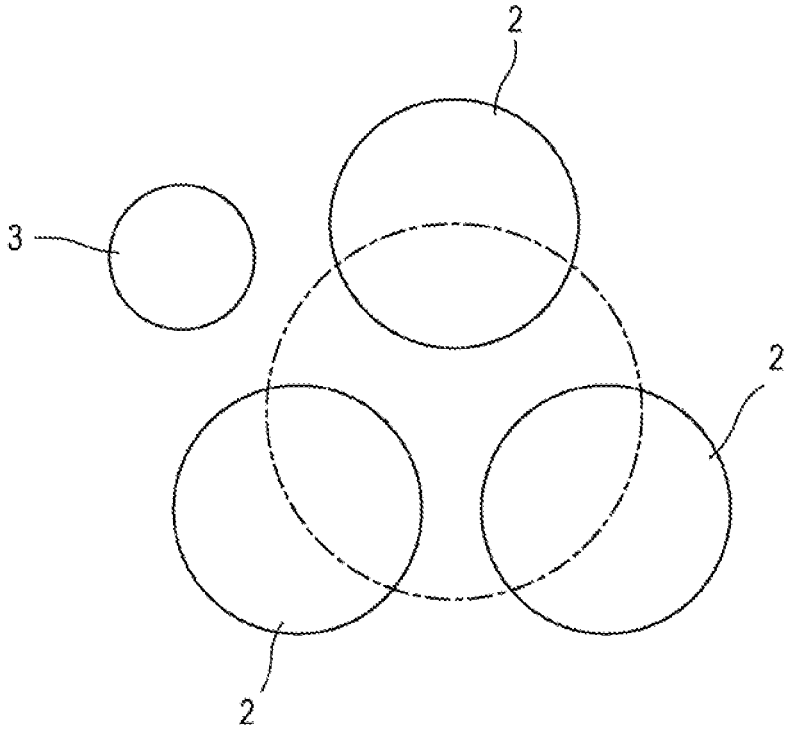
FIG. 2 is a cross-sectional view taken along line II-II of FIG. 1.

FIG. 1 and FIG. 2 are schematic diagrams of an embodiment of a bell-less charging device for a blast furnace that is used in accordance with aspects of the present invention. FIG. 1 is an overall perspective view of a bell-less charging device 1*a*, which is a cutaway view of a portion on top of a furnace body. FIG. 2 is a cross-sectional view taken along line II-II of FIG. 1. The bell-less charging device 1*a* includes three main hoppers 2 and one auxiliary hopper 3. Hopper central axes of the main hoppers 2 are positioned on one imaginary circle that has a center coinciding with a central axis of the furnace body. The auxiliary hopper 3 is disposed outside of the plurality of main hoppers 2.

Figure 3:
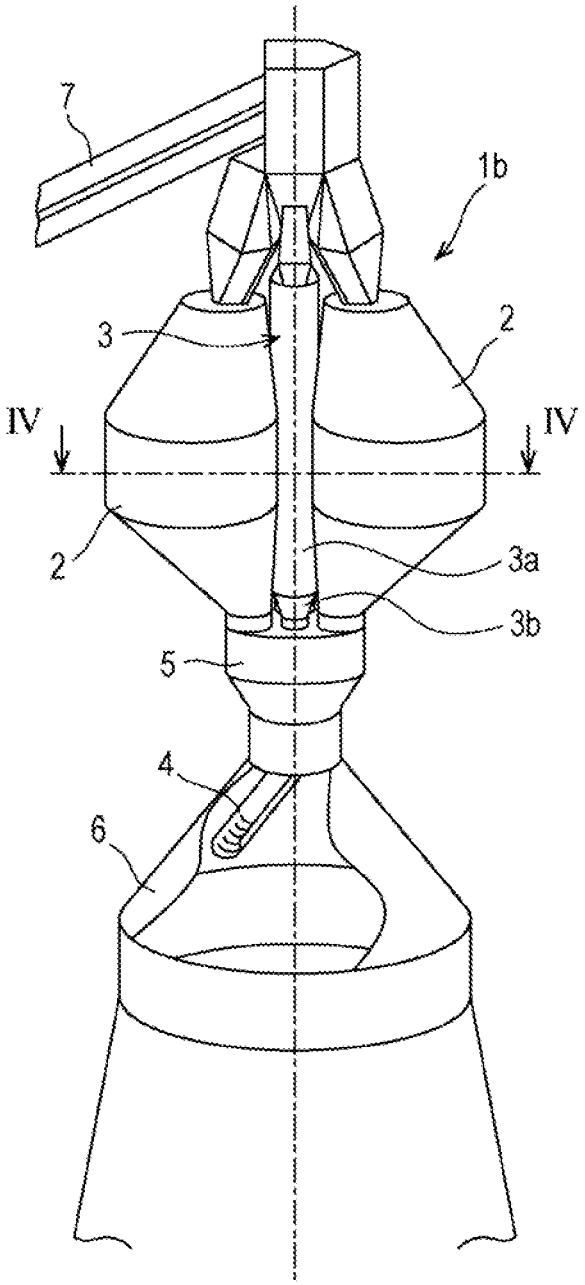
FIG. 3 is an overall perspective view of a bell-less charging device 1*b*, which is a cutaway view of a portion on top of a furnace body.
Figure 4:
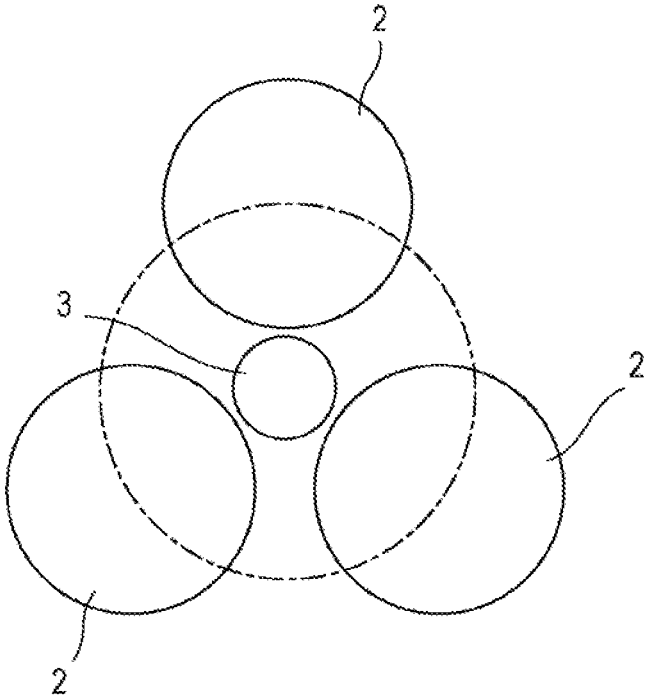
FIG. 4 is a cross-sectional view taken along line IV-IV of FIG. 3.

FIG. 3 and FIG. 4 are schematic diagrams of another embodiment of a bell-less charging device for a blast furnace that is used in accordance with aspects of the present invention. FIG. 3 is an overall perspective view of a bell-less charging device 1*b*, which is a cutaway view of a portion on top of a furnace body. FIG. 4 is a cross-sectional view taken along line IV-IV of FIG. 3. As with the embodiment of FIG. 1 and FIG. 2, the bell-less charging device 1*b* also includes three main hoppers 2 and one auxiliary hopper 3. Hopper central axes of the main hoppers 2 are positioned on one imaginary circle that has a center coinciding with a central axis of the furnace body. In the bell-less charging device 1*b*, the auxiliary hopper 3 is disposed at a center inside the three main hoppers 2 in a manner such that central axes of a hopper body 3*a* and an outlet 3*b* of the auxiliary hopper 3 coincide with the central axis of the furnace body of the blast furnace.

In the above-described bell-less charging devices 1*a* and 1*b* of the embodiments, the ore discharged from the main hoppers 2 and the small-size coke discharged from the auxiliary hopper 3 are charged into the blast furnace from a rotating chute 4 by way of a collecting hopper 5. In FIG. 1 and FIG. 3, reference numeral 6 denotes a blast furnace body, and reference numeral 7 denotes a charging belt conveyor. A flow regulating valve (not illustrated) is provided at the outlet of the auxiliary hopper 3 to control a rate of discharge of the small-size coke.

Details of methods for charging raw materials according to aspects of the present invention will now be described with reference to examples, in which the bell-less charging device 1*a* or 1*b* described above is used.

Non Patent Literature 1 states that raw materials charged into a region defined by a blast furnace dimensionless radius of 0.12 or less reach a deadman (the blast furnace dimensionless radius is a dimensionless radius of a furnace determined assuming that a start point is a furnace center and designated as 0, and an end point is a furnace wall and designated as 1.0). Accordingly, when a raw material having a small particle diameter is charged into a region defined by a dimensionless radius of 0.12 or less, the fine raw material reaches the deadman and, consequently, may interfere with the gas permeability of a deadman portion. This phenomenon can be avoided by charging small-size coke to a region outside of the dimensionless radius of 0.12 (on the furnace wall side).

Figure 5:
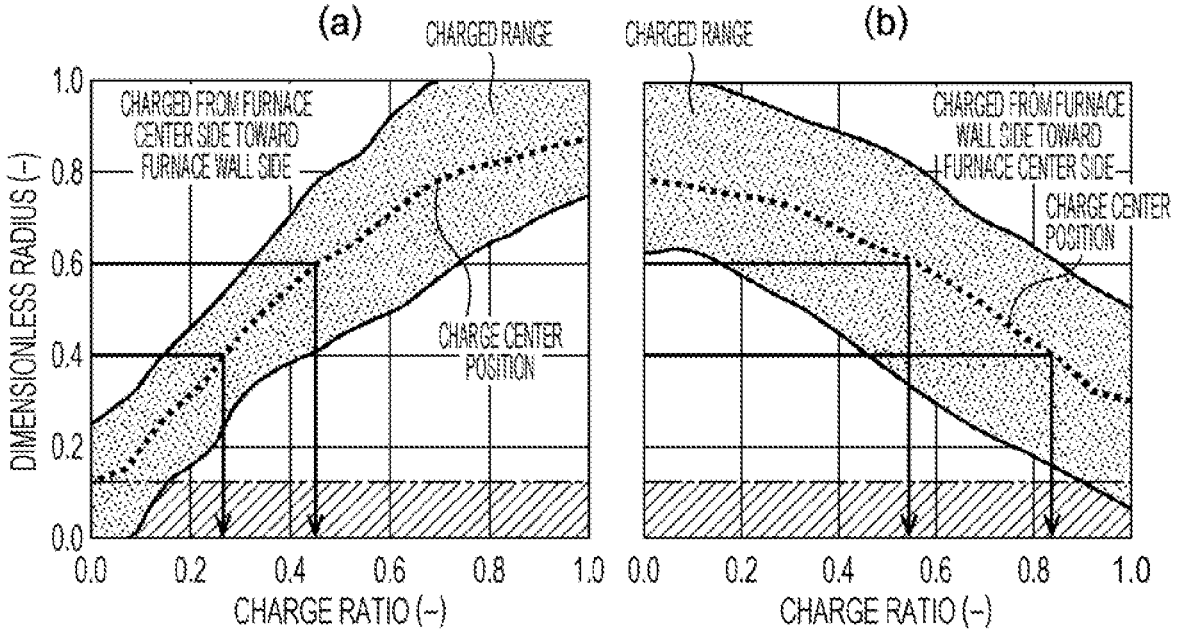
FIG. 5 is a graph illustrating a raw material charged range achieved with a rotating chute 4, the charged range being illustrated in terms of a relationship between a dimensionless radius and a charge ratio.
Figure 9:
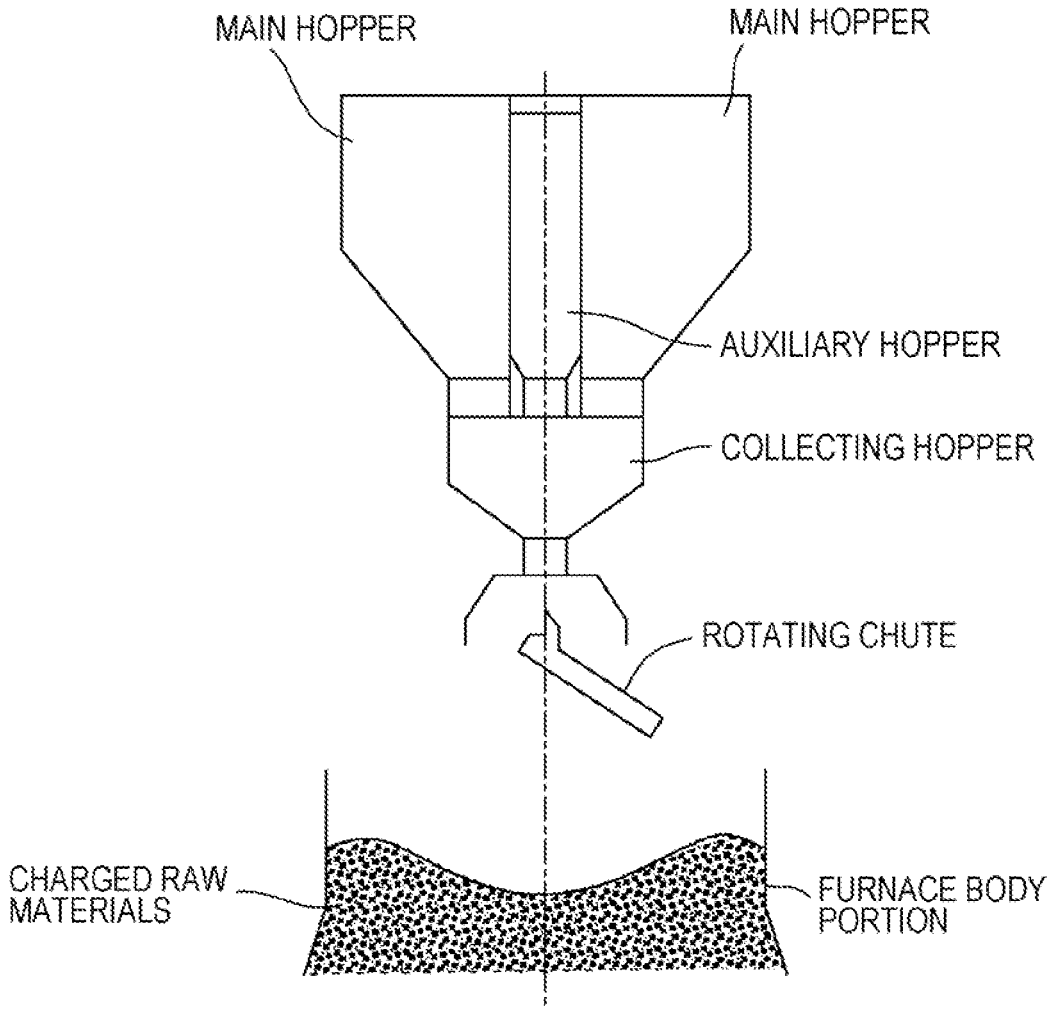
FIG. 9 is a schematic diagram of a model testing device used in Examples.

FIG. 5 is a graph illustrating a raw material charged range achieved with a rotating chute 4, the charged range being illustrated in terms of a relationship between the dimensionless radius and a charge ratio. The charged range illustrated in FIG. 5 is a range determined using a 1/20-scale model testing device, which is illustrated in FIG. 9. FIG. 5(*a*) illustrates a raw material charged range associated with a case in which raw materials are sequentially charged from the furnace center side toward the furnace wall side. FIG. 5(*b*) illustrates a raw material charged range associated with a case in which raw materials are sequentially charged from the furnace wall side toward the furnace center side. Here, the term "charged range" refers to a range in which raw materials spread in furnace radial directions when the raw materials have been charged into a blast furnace from the rotating chute 4.

A raw material deposition surface in a top of a blast furnace has a mortar-like shape such that a central portion of the furnace is located at a minimum height. A charge center position is defined as any of the positions on which the raw materials from the rotating chute 4 fall, on the sloping surface. A range in which the raw materials spread from the charge center position toward the furnace center and the furnace wall and are deposited is designated as the charged range. In a case where the rotating chute 4 is moved from the furnace center side toward the furnace wall side, the charging of raw materials begins from a lower position of the sloping surface having a mortar-like shape, and, therefore, spreading of the raw materials toward the furnace center is inhibited. Accordingly, the charged range is narrower in a case where raw materials are charged by moving the rotating chute 4 from the furnace center side toward the furnace wall side than in a case where raw materials are charged by moving the rotating chute 4 from the furnace wall side toward the furnace center side. In FIG. 5, the "charge ratio" on the horizontal axis is a proportion of the ore that has been charged associated with the corresponding charge position in the furnace radial direction, based on a total amount of the ore to be charged per batch, in a case where amounts of raw materials per batch are sequentially charged by using the rotating chute 4 from the furnace center side toward the furnace wall side or from the furnace wall side toward the furnace center side. (This also applies to FIG. 8, FIG. 11, and FIG. 12.) For example, a "charge ratio of 0.1" indicates that charging of 10 mass % of ore, based on the total amount of the ore to be charged per batch, has been completed in association with the corresponding charge position.

Figure 6:
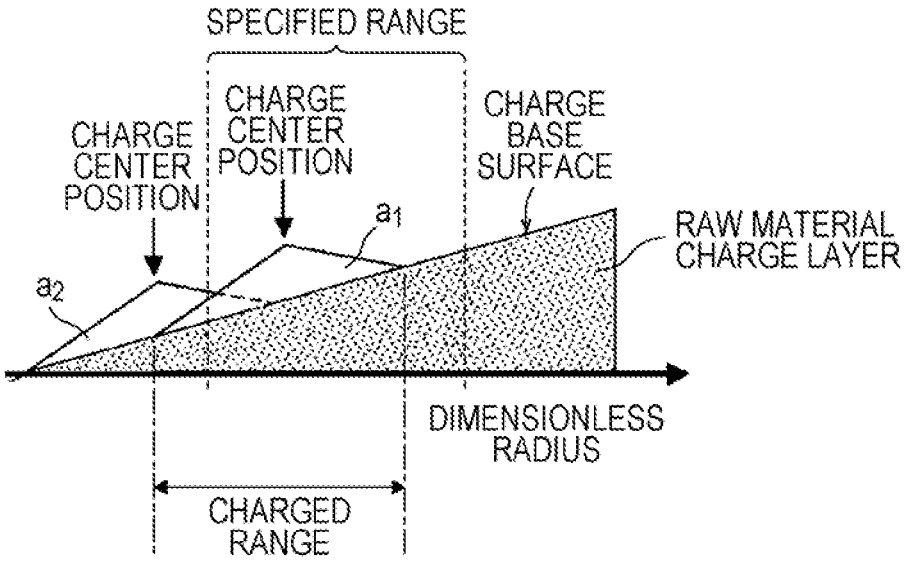
FIG. 6 is a vertical cross-sectional view of an uppermost portion of raw material charge layers in a furnace.

FIG. 6 is a vertical cross-sectional view of an uppermost portion of raw material charge layers in a furnace. The charged range and the charge center position, which is a center of the range, are schematically illustrated in FIG. 6.

As can be seen from FIG. 5(*a*), in a case where raw materials are sequentially charged from the furnace center side toward the furnace wall side, one way to avoid small-size coke from being charged into a region defined by a dimensionless radius of 0.12 or less is to ensure that the small-size coke is charged when or after the charge ratio has become 0.15 or greater. As can be seen from FIG. 5(*b*), in a case where raw materials are sequentially charged from the furnace wall side toward the furnace center side, one way to avoid small-size coke from being charged into a region defined by a dimensionless radius of 0.12 or less is to ensure that the small-size coke is charged while the charge ratio is 0.9 or less.

Based on the above results, a preferred region into which small-size coke is to be mixed is a region defined by a charge ratio of 0.15 or greater in a case where raw materials are sequentially charged from the furnace center side toward the furnace wall side and is a region defined by a charge ratio of 0.9 or less in a case where raw materials are sequentially charged from the furnace wall side toward the furnace center side.

Accordingly, in accordance with aspects of the present invention, in a case where the ore charged in a main hopper 2 is discharged and then sequentially charged from the furnace center side toward the furnace wall side by using the rotating chute 4 (a first method for charging raw materials according to aspects of the present invention), only the ore is charged from the rotating chute 4 after the charging of the ore is started, at least until charging of 15 mass % of the ore is completed based on the total amount of the ore to be charged per batch; then, at a point in time, the charging of the small-size coke charged in the auxiliary hopper 3 is started; and then, the small-size coke is charged together with the ore from the rotating chute 4 for a time period. The time at which the discharging of the small-size coke is to be started may be the point in time at which the charging of 15 mass % of the ore is completed based on the total amount of the ore to be charged per batch or may be some point in time after a certain time period elapses after the charging of 15 mass % of the ore is completed based on the total amount of the ore to be charged per batch. The charging of the small-size coke may be performed until the charging of the total amount of the ore is completed or may be stopped before the charging of the total amount of the ore is completed. The time at which the charging of the small-size coke is to be started and the time period during which the charging of the small-size coke is to be performed may be determined in accordance with the small-size coke mixed state that is required.

In a case where the ore charged in a main hopper 2 is discharged and then sequentially charged from the furnace wall side toward the furnace center side by using the rotating chute 4 (a second method for charging raw materials according with aspects of the present invention), the charging of the small-size coke charged in the auxiliary hopper 3 is started simultaneously with the start of the charging of the ore or at a point in time after the start of the charging, then the small-size coke is charged together with the ore from the rotating chute 4, and the charging of the small-size coke is stopped at least before the point in time at which charging of 90 mass % of the ore is completed based on the total amount of the ore to be charged per batch. In this case, too, the time at which the charging of the small-size coke is to be started and the time period during which the charging of the small-size coke is to be performed may be determined in accordance with the small-size coke mixed state that is required.

Figure 7:
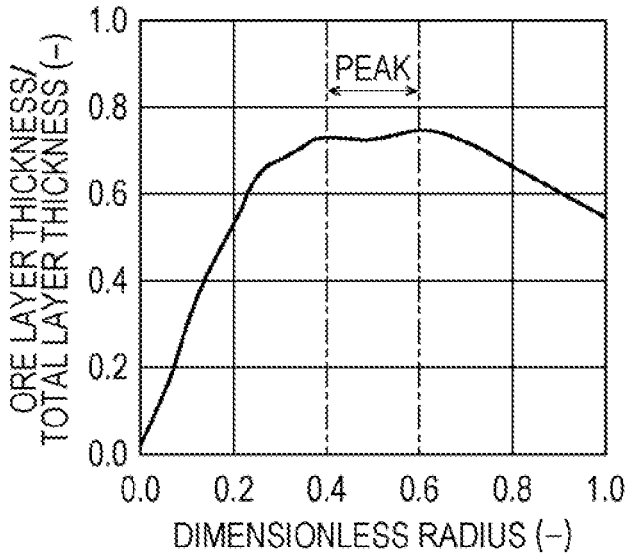
FIG. 7 is a graph illustrating a radial distribution of a standard ore layer thickness.

FIG. 7 is a graph illustrating a radial distribution of a standard ore layer thickness. In FIG. 7, the vertical axis represents the "ore layer thickness/total layer thickness (ore layer thickness+coke layer thickness)" of the uppermost portion of the charge layers, and the horizontal axis represents the dimensionless radius. As shown in FIG. 7, the ore layer thickness is large particularly in the region defined by dimensionless radii of 0.4 to 0.6. In this region, a reaction load of the ore is high, and, therefore, it is presumed that by mixing a large amount of small-size coke into the region, an effect of the mixed coke of promoting the reduction reaction of ore can be produced. A large amount of small-size coke can be charged into such a region by ensuring that raw materials containing a large amount of coke mixed therewith is charged in a manner such that the charge center position, illustrated in FIG. 6, is within the region defined by dimensionless radii of 0.4 to 0.6. With reference to FIGS. 5(*a*) and 5(*b*), the region defined by dimensionless radii of 0.4 to 0.6 corresponds to a region defined by charge ratios of 0.27 to 0.46 in a case where raw materials are sequentially charged from the furnace center side toward the furnace wall side and corresponds to a region defined by charge ratios of 0.54 to 0.83 in a case where raw materials are sequentially charged from the furnace wall side toward the furnace center side. Accordingly, in accordance with aspects of the present invention, it is preferable that for a portion or the whole of the region defined by the dimensionless radii, the rate of discharge of the small-size coke to be discharged from the auxiliary hopper 3 be increased compared with a rate of discharge employed for a different time period. In this case, a large amount of small-size coke can be charged into the region defined by the above-mentioned dimensionless radii, and, therefore, the reduction reaction of ore can be promoted.

In the case where raw material charging in which the rate of discharge of the small-size coke is increased in a region defined by specific dimensionless radii (region defined by specific charge ratios) such as that described above is to be performed, it is necessary to ensure that the charge center position is within the specified range (the region defined by specific dimensionless radii) as indicated by a heap $a_1$ of charged raw materials illustrated in FIG. 6. It is not preferable that the charge center position be outside of the specified range (the region defined by the specific dimensionless radii) as in the case of a heap $a_2$ of charged raw materials illustrated in FIG. 6, for example; in such a case, a majority of the heap of charged raw materials may be outside of the specified range although there may be some overlap between the charged range and the specified range.

Figure 8:
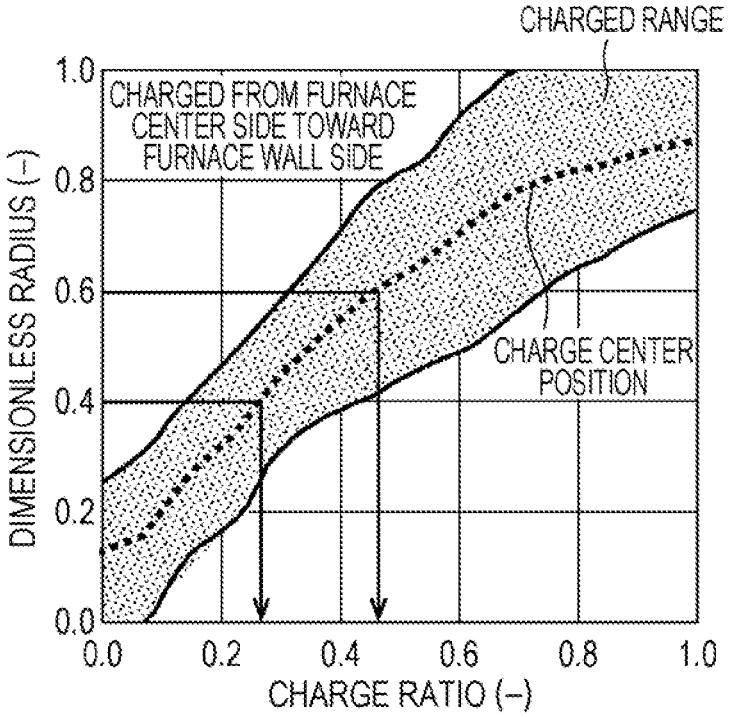
FIG. 8 is a graph illustrating a raw material charged range and a charge center position, which are illustrated in terms of a relationship between the dimensionless radius and the charge ratio.

FIG. 8 is a graph illustrating a raw material charged range and a charge center position, which are illustrated in terms of a relationship between the dimensionless radius and the charge ratio. As illustrated in FIG. 8, the region defined by dimensionless radii of 0.4 to 0.6, with respect to the charge center position, corresponds to a region defined by charge ratios of 0.27 to 0.46.

Accordingly, in accordance with aspects of the present invention, in a case where the ore charged in a main hopper 2 is discharged and then sequentially charged from the furnace center side toward the furnace wall side by using the rotating chute 4 (the first method for charging raw materials according to aspects of the present invention), it is preferable that, for a portion or all of the time period from the point in time at which charging of 27 mass % of the ore is completed to the point in time at which charging of 46 mass % of the ore is completed, based on the total amount of the ore to be charged per batch, the rate of discharge of the small-size coke to be discharged from the auxiliary hopper 3 be increased compared with the rate of discharge employed for a different time period. In the case where the ore is sequentially charged from the furnace center side toward the furnace wall side, the time period from the point in time at which charging of 27 mass % of the ore is completed to the point in time at which charging of 46 mass % of the ore is completed, based on the total amount of the ore to be charged per batch, corresponds to a region in which the thickness of the deposited ore is large within the furnace, and, therefore, it is expected that mixing a large amount of small-size coke into this region promotes the reduction reaction of ore. In this case, it is preferable that the rate of discharge of the small-size coke be 1.5 to 2 times the rate of discharge employed for a different time period. When the rate of discharge of the small-size coke is 1.5 times or greater the rate of discharge employed for a different time period, the reduction reaction of ore is noticeably promoted. On the other hand, it is not preferable to increase the rate of discharge of the small-size coke to greater than 2 times the rate of discharge employed for a different time period because in such a case, the progressing rate of the reduction reaction of ore saturates.

In a case where the ore charged in a main hopper 2 is discharged and then sequentially charged from the furnace wall side toward the furnace center side by using the rotating chute 4 (the second method for charging raw materials according to aspects of the present invention), it is preferable that, for a portion or all of the time period from the point in time at which charging of 54 mass % of the ore is completed to the point in time at which charging of 83 mass % of the ore is completed, based on the total amount of the ore to be charged per batch, the rate of discharge of the small-size coke to be discharged from the auxiliary hopper 3 be increased compared with the rate of discharge employed for a different time period. In the case where the ore is sequentially charged from the furnace wall side toward the furnace center side, the time period from the point in time at which charging of 54 mass % of the ore is completed to the point in time at which charging of 83 mass % of the ore is completed, based on the total amount of the ore to be charged per batch, corresponds to a region in which the thickness of the deposited ore is large within the furnace, and, therefore, it is expected that mixing a large amount of small-size coke into this region promotes the reduction reaction of ore. In this case, too, for a reason similar to that described above, it is preferable that the rate of discharge of the small-size coke be 1.5 to 2 times the rate of discharge employed for a different time period.

In accordance with aspects of the present invention, it is preferable that a gas composition distribution in a furnace radial direction within the blast furnace be measured at the furnace top portion or at a shaft upper portion to determine a distribution of a CO gas utilization ratio associated with the furnace radial direction, and, for a region in the furnace radial direction in which the CO gas utilization ratio is greater than or equal to an average value of the CO gas utilization ratio associated with the furnace radial direction, the rate of discharge of the small-size coke to be discharged from the auxiliary hopper 3 be increased compared with a rate of discharge employed for a different region in the furnace radial direction. A region in which the CO gas utilization ratio associated with the furnace radial direction is high corresponds to a region that has a large ore layer thickness and, therefore, has a high ore reduction load. Accordingly, it is expected that mixing a large amount of small-size coke into such a region promotes the reduction reaction of ore. In this case, too, for a reason similar to that described above, it is preferable that the rate of discharge of the small-size coke be set to be 1.5 to 2 times the rate of discharge employed for a different region in the furnace radial direction.

The CO gas utilization ratio is defined by equation (1) below, according to the composition of the gas within the furnace.

$$\text{CO gas utilization ratio}=100\times(\text{volume percentage of } CO_2)/[(\text{volume percentage of CO})+(\text{volume percentage of } CO_2)] \quad (1)$$

At the blast furnace top portion or the shaft upper portion, a furnace top gas probe or a shaft gas probe is inserted in the furnace radial direction, and the gas within the furnace is sampled in 5 or greater and 10 or less locations in the furnace radial direction. The samples are then subjected to gas analysis to determine the compositions of the gas of the locations in the furnace radial direction. From the compositions of the gas of the locations in the furnace radial direction, the gas utilization ratio of each of the locations in the furnace radial direction and a distribution of the CO gas utilization ratio associated with the furnace radial direction can be determined. The average value of the CO gas utilization ratio is an arithmetic mean of the CO gas utilization ratios of all the measurement locations.

In a case where the bell-less charging device 1*a* of FIG. 1 and FIG. 2 is compared with the bell-less charging device 1*b* of FIG. 3 and FIG. 4, in the bell-less charging device 1*a* of FIG. 1 and FIG. 2, in which the auxiliary hopper 3 is disposed offset from the central axis of the blast furnace, a difference occurs in the position on which the raw material flow falls, between a case in which a rotating position of the rotating chute 4 is on an auxiliary hopper side and a case in which the rotating position is on a non auxiliary hopper side, with respect to the central axis of the blast furnace. In contrast, in the bell-less charging device 1*b* of FIG. 3 and FIG. 4, in which the central axes of the body and the outlet of the auxiliary hopper 3 coincide with the central axis of the furnace body, the absolute values of the rate vectors of the raw material discharged from the main hoppers 2 and the raw material discharged from the auxiliary hopper 3 are the same regarding all the main hoppers 2, and, therefore, a difference in the position on which the raw material flow falls such as that described above does not occur. Accordingly, the position on which the raw materials fall can be easily controlled with high precision. Since the auxiliary hopper 3 is disposed directly above the collecting hopper 5, there is no need to provide a raw material flow path passing from the auxiliary hopper 3 to the collecting hopper 5, and, for example, the time at which the discharging is to be initiated can be easily adjusted.

In accordance with aspects of the present invention, an amount of small-size coke for a plurality of charges is charged into the auxiliary hopper 3, and, from the auxiliary hopper 3, an amount of the small-size coke per charge is discharged in batches. Accordingly, the pressure adjustment time associated with the discharging of raw materials can be reduced, and as a result, the production volume of a blast furnace can be maintained even in a case where a small-amount raw material is to be charged into the blast furnace by using a discrete auxiliary hopper.

EXAMPLES

A charging test for ore and coke was conducted by using a 1/20-scale model testing device. FIG. 9 is a schematic diagram of a model testing device used in Examples. A flow regulating valve (not illustrated) was disposed at an outlet of an auxiliary hopper of the model testing device to control the rate of discharge of small-size coke. In Invention Examples, ore was charged into main hoppers, and small-size coke was charged into the auxiliary hopper. The small-size coke was discharged from the auxiliary hopper during a portion of the time period during which the ore was discharged from the main hoppers. On the other hand, in Comparative Examples, only main hoppers were used, in accordance with a method of the related art, that is, ore and small-size coke were charged into the main hoppers such that a predetermined condition was achieved, and the ore and the small-size coke were discharged from the main hoppers.

Figure 10:
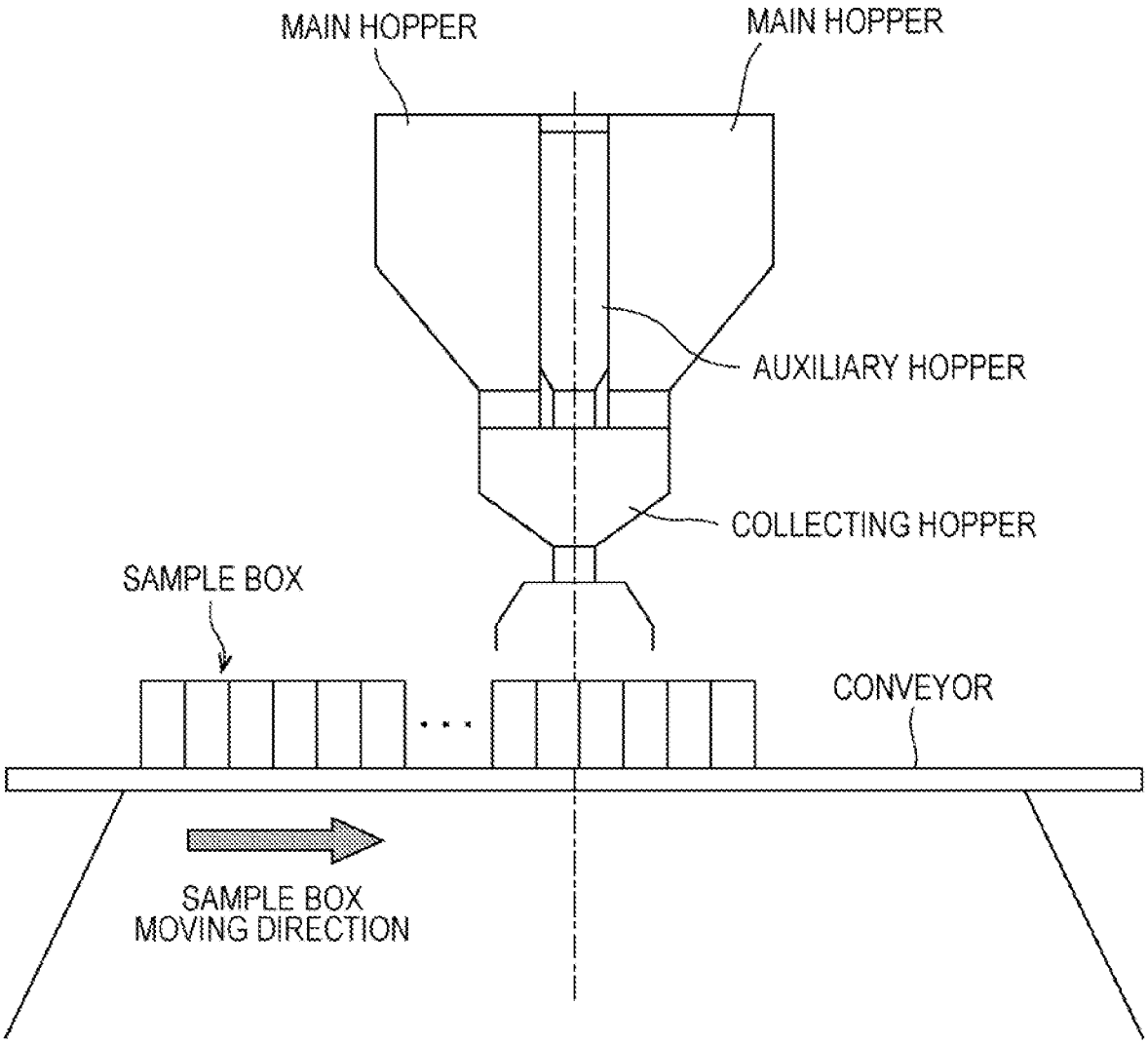
FIG. 10 is a diagram illustrating how discharged raw materials, which were discharged from the model testing device, were collected in portions.

FIG. 10 is a diagram illustrating how discharged raw materials, which were discharged from the model testing device, were collected in portions. As illustrated in FIG. 10, in this test, the rotating chute was removed from the model testing device, a plurality of sample boxes were mounted onto a feed conveyor, and the sample boxes were moved at a constant speed synchronously with the discharging of raw materials. Accordingly, the discharged raw materials were collected in portions. The discharged raw materials that were collected were subjected to specific gravity separation, which utilized the difference in specific gravity between the ore and the coke, to determine the ratio of the small-size coke in the discharged raw materials.

Figure 11:
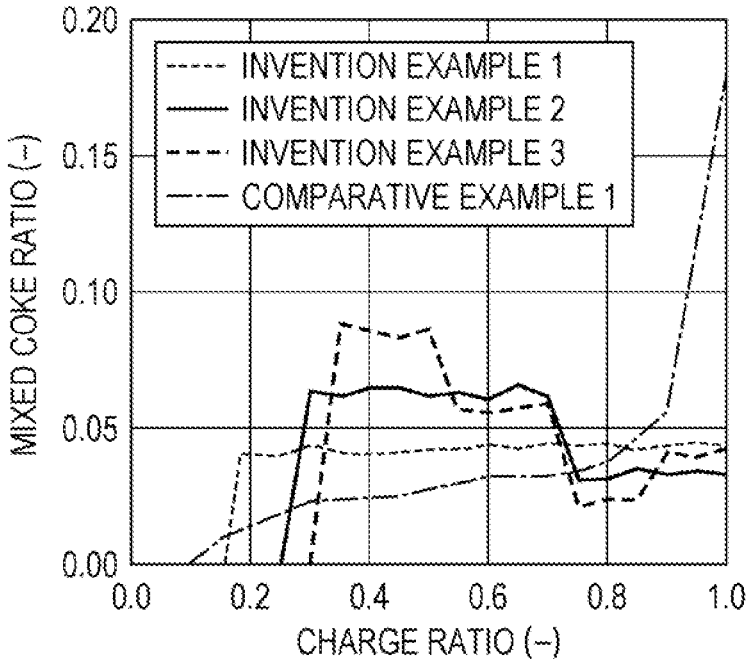
FIG. 11 is a graph illustrating a relationship between a mixed coke rate and the charge ratio associated with a case in which raw materials were sequentially charged from the furnace center side toward the furnace wall side.

With the model testing device, a charge test was conducted in association with a case in which raw materials are sequentially charged from the furnace center side toward the furnace wall side by using a rotating chute, and the ratio of the small-size coke in the discharged raw materials (mixed coke rate) was measured in the manner described above. FIG. 11 is a graph illustrating a relationship between the mixed coke rate and the charge ratio associated with the case in which raw materials were sequentially charged from the furnace center side toward the furnace wall side.

As can be seen from FIG. 11, in Comparative Example 1, in which a method of the related art was used, the small-size coke was not discharged during an initial stage of the discharging of raw materials; the small-size coke was discharged when or after the charge ratio reached 0.1. Since segregation of the small-size coke had an influence within the main hoppers, the mixed coke rate rapidly increased during a final stage of the discharging in which the charge ratio was 0.9 to 1.0, and, therefore, the mixed coke rate in an intermediate period of the discharging was at a low level.

In contrast, in Invention Examples 1 to 3, the small-size coke was discharged when or after the charge ratio reached 0.15, and in addition, the amount of the small-size coke discharged from the auxiliary hopper could be controlled; thus, in Invention Example 1, the mixed coke rate was substantially uniform throughout the whole time period during which the small-size coke was discharged. In Invention Examples 2 and 3, the mixed coke rate was increased particularly in an intermediate period of the discharging, which was associated with a large ore layer thickness.

Figure 12:
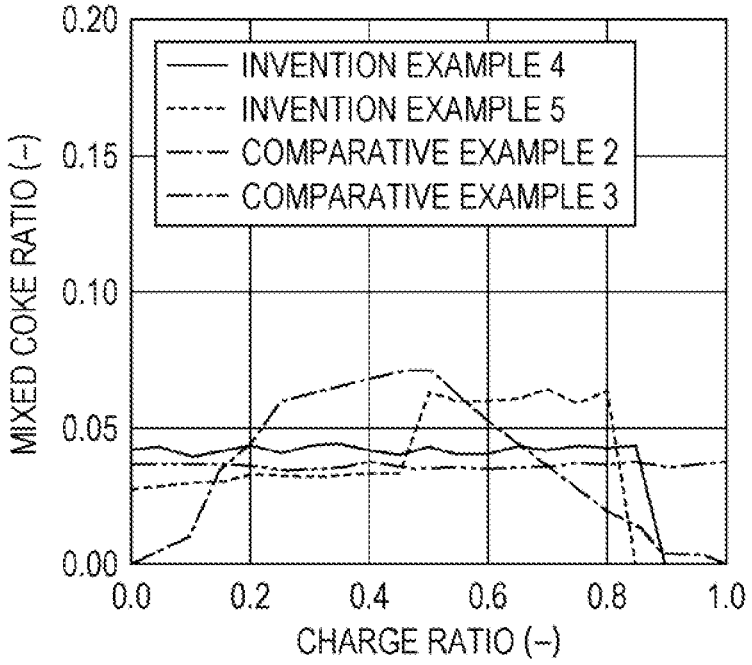
FIG. 12 is a graph illustrating a relationship between the mixed coke rate and the charge ratio associated with a case in which raw materials were sequentially charged from the furnace wall side toward the furnace center side.

A charge test, such as that described above, was conducted in association with a case in which raw materials are sequentially charged from the furnace wall side toward the furnace center side by using a rotating chute, and the ratio of the small-size coke in the discharged raw materials (mixed coke rate) was measured in the manner described above. FIG. 12 is a graph illustrating a relationship between the mixed coke rate and the charge ratio associated with the case in which raw materials were sequentially charged from the furnace wall side toward the furnace center side.

As can be seen from FIG. 12, in Comparative Example 2, in which a method of the related art was used as with Comparative Example 1 of FIG. 11, an influence of segregation of the small-size coke and the like existed in the main hoppers, and, therefore, it was difficult to drastically change the mixed coke rate. In Comparative Example 3, the charging of ore from the main hoppers and the charging of small-size coke from the auxiliary hopper were carried out simultaneously, and the small-size coke was mixed with the ore substantially uniformly over the range from the furnace wall side to the furnace center side. In contrast, in Invention Examples 4 and 5, the discharging of the small-size coke was stopped before the charge ratio reached 0.9, and in addition, the amount of the small-size coke discharged from the auxiliary hopper could be controlled; thus, in Invention Example 4, the mixed coke rate was substantially uniform throughout the whole time period during which the small-size coke was discharged. In Invention Example 5, the mixed coke rate was increased particularly in an intermediate period of the discharging, which was associated with a large ore layer thickness.

Table 1 summarizes the results of an evaluation of the operation conditions of Examples and Comparative Examples, which was conducted by using a blast furnace operation prediction model. As shown in Table 1, Invention Examples 1 to 5 had a lower reduction agent rate and a lower pressure drop of the burden layer than Comparative Examples 1 to 3. These results demonstrate that charging ore and small-size coke as in any of Invention Examples 1 to 5 results in improved mixing characteristics of small-size coke, which in turn improves gas permeability and reducibility and, consequently, lowers the reduction agent rate of a blast furnace.

All of Invention Examples 1 to 3, in which raw materials were sequentially charged from the furnace center side toward the furnace wall side by using a rotating chute, had improved gas permeability and reducibility compared with Comparative Example 1. In particular, the gas permeability and reducibility improving effect was pronounced in Invention Examples 2 and 3. In these examples, a large amount of small-size coke was charged into a region defined by charge ratios of approximately 0.3 to 0.7, which was associated with a large ore layer thickness, and an amount of the small-size coke was maintained also in a region defined by a charge ratio of approximately 1.0, in which the raw materials were charged into a portion near the blast furnace periphery. In particular, the reduction agent rate was lowest in Invention Example 3, in which the greatest amount of small-size coke was charged into a region defined by charge ratios of 0.27 to 0.46, in which the ore layer thickness was large.

Both of Invention Examples 4 and 5, in which raw materials were sequentially charged from the furnace wall side toward the furnace center side by using a rotating chute, had improved gas permeability and reducibility compared with Comparative Examples 2 and 3. It is seen that compared with Comparative Example 2, in which it was difficult to drastically change the mixed coke rate, in Invention Examples 4 and 5, gas permeability and reducibility were improved, which was achieved by mixing small-size coke into a region between the furnace wall side and a region defined by a charge ratio of 0.9 near the furnace center. In particular, the reduction agent rate was significantly low in Invention Example 5, in which the amount of small-size coke was increased in a region defined by charge ratios of 0.54 to 0.83, in which the ore layer thickness was large. On the other hand, in Comparative Example 3, in which small-size coke was mixed consistently uniformly from the furnace wall side to the furnace center side, some small-size coke reached a blast furnace axial central region, and as a result, some small-size coke remained within the furnace, and, therefore, no gas permeability improving effect was observed.

The results described above confirm that charging small-size coke into an appropriate region within a furnace with high precision results in improved gas permeability and reducibility within the blast furnace, which, consequently, lowers the reduction agent rate of the blast furnace.

TABLE 1

| | Invention Example 1 | Invention Example 2 | Invention Example 3 | Invention Example 4 | Invention Example 5 | Comparative Example 1 | Comparative Example 2 | Comparative Example 3 |
|---|---|---|---|---|---|---|---|---|
| Tapping ratio ($t/m^3/day$) | 2.0 | 2.0 | 2.0 | 2.0 | 2.0 | 2.0 | 2.0 | 2.0 |
| Reduction agent rate (kg/t) | 499 | 496 | 495 | 501 | 497 | 506 | 507 | 507 |
| Coke rate (kg/t) | 351 | 348 | 347 | 353 | 349 | 358 | 359 | 359 |
| Pulverized coal rate (kg/t) | 148 | 148 | 148 | 148 | 148 | 148 | 148 | 148 |
| Gas utilization ratio (%) | 49.9 | 50.3 | 50.5 | 49.5 | 50.3 | 48.7 | 48.6 | 48.6 |
| Pressure drop of burden layer ($kPa/(Nm^3/min)$) | 20.8 | 20.6 | 20.6 | 21.8 | 20.6 | 25.0 | 26.2 | 25.5 |

REFERENCE SIGNS LIST

1*a* Bell-less charging device
1*b* Bell-less charging device
2 Main hopper
3 Auxiliary hopper
3*a* Hopper body
3*b* Outlet
4 Rotating chute
5 Collecting hopper
6 Blast furnace body
7 Charging belt conveyor

The invention claimed is:

1. A method for charging raw materials into a blast furnace, the blast furnace including a bell-less charging device that includes a plurality of main hoppers and an auxiliary hopper at a furnace top portion, the auxiliary hopper having a smaller capacity than the main hoppers, the method comprising discharging ore charged in at least one of the plurality of main hoppers into a rotating chute through a collecting hopper and then sequentially charging the ore from a furnace center side toward a furnace wall side by using the rotating chute, wherein after charging of the ore is started, only the ore is charged from the rotating chute at least until charging of 15 mass % of the ore is completed based on a total amount of the ore to be charged per batch; then, at a point in time, discharging of small-size coke charged in the auxiliary hopper into the rotating chute through the collecting hopper is started such that the small-size coke is charged together with the ore from the rotating chute for a time period.

2. The method for charging raw materials into a blast furnace according to claim 1, wherein the small-size coke is discharged in batches from the auxiliary hopper.

3. The method for charging raw materials into a blast furnace according to claim 2, wherein, for a portion or all of a time period from a point in time at which charging of 27 mass % of the ore is completed to a point in time at which charging of 46 mass % of the ore is completed, based on the total amount of the ore to be charged per batch, a rate of discharge of the small-size coke to be discharged from the auxiliary hopper is increased compared with a rate of discharge employed outside of the time period.

4. The method for charging raw materials into a blast furnace according to claim 3, wherein, for a portion or all of the time period from the point in time at which charging of 27 mass % of the ore is completed to the point in time at which charging of 46 mass % of the ore is completed, based on the total amount of the ore to be charged per batch, the rate of discharge of the small-size coke to be discharged from the auxiliary hopper is set to be 1.5 to 2 times the rate of discharge employed outside of the time period.

5. The method for charging raw materials into a blast furnace according to claim 2, wherein a gas composition distribution in a furnace radial direction within the blast furnace is measured to determine a distribution of a CO gas utilization ratio associated with the furnace radial direction, and, for a region in the furnace radial direction in which the CO gas utilization ratio is greater than or equal to an average value of the CO gas utilization ratio associated with the furnace radial direction, the rate of discharge of the small-size coke to be discharged from the auxiliary hopper is set to be 1.5 to 2 times the rate of discharge employed outside of the region in the furnace radial direction.

6. The method for charging raw materials into a blast furnace according to claim 1, wherein the auxiliary hopper has a hopper body and an outlet, and the auxiliary hopper is provided at a position such that central axes of the hopper body and the outlet coincide with a central axis of a furnace body of the blast furnace.

7. The method for charging raw materials into a blast furnace according to claim 2, wherein the auxiliary hopper has a hopper body and an outlet, and the auxiliary hopper is provided at a position such that central axes of the hopper body and the outlet coincide with a central axis of a furnace body of the blast furnace.

8. The method for charging raw materials into a blast furnace according to claim 3, wherein the auxiliary hopper has a hopper body and an outlet, and the auxiliary hopper is provided at a position such that central axes of the hopper body and the outlet coincide with a central axis of a furnace body of the blast furnace.

9. The method for charging raw materials into a blast furnace according to claim 4, wherein the auxiliary hopper has a hopper body and an outlet, and the auxiliary hopper is provided at a position such that central axes of the hopper body and the outlet coincide with a central axis of a furnace body of the blast furnace.

10. The method for charging raw materials into a blast furnace according to claim 5, wherein the auxiliary hopper has a hopper body and an outlet, and the auxiliary hopper is provided at a position such that central axes of the hopper body and the outlet coincide with a central axis of a furnace body of the blast furnace.

11. A method for charging raw materials into a blast furnace, the blast furnace including a bell-less charging device that includes a plurality of main hoppers and an auxiliary hopper at a furnace top portion, the auxiliary hopper having a smaller capacity than the main hoppers, the method comprising discharging ore charged in at least one of the plurality of main hoppers into a rotating chute through a collecting hopper and then sequentially charging the ore from a furnace wall side toward a furnace center side by using the rotating chute, wherein discharging of small-size coke charged in the auxiliary hopper into the rotating chute through a collecting hopper is started simultaneously with the ore or at a point in time after the start of the ore, and then the small-size coke is charged together with the ore from the rotating chute; and charging of the small-size coke is stopped at least before a point in time at which charging of 90 mass % of the ore is completed based on a total amount of the ore to be charged per batch.

12. The method for charging raw materials into a blast furnace according to claim 11, wherein the small-size coke is discharged in batches from the auxiliary hopper.

13. The method for charging raw materials into a blast furnace according to claim 12, wherein, for a portion or all of a time period from a point in time at which charging of 54 mass % of the ore is completed to a point in time at which charging of 83 mass % of the ore is completed, based on the total amount of the ore to be charged per batch, a rate of discharge of the small-size coke to be discharged from the auxiliary hopper is increased compared with a rate of discharge employed outside of the time period.

14. The method for charging raw materials into a blast furnace according to claim 13, wherein, for a portion or all of the time period from the point in time at which charging of 54 mass % of the ore is completed to the point in time at which charging of 83 mass % of the ore is completed, based on the total amount of the ore to be charged per batch, the rate of discharge of the small-size coke to be discharged from the auxiliary hopper is set to be 1.5 to 2 times the rate of discharge employed outside of the time period.

15. The method for charging raw materials into a blast furnace according to claim 12, wherein the gas composition distribution in the furnace radial direction within the blast furnace is measured to determine the distribution of the CO gas utilization ratio associated with the furnace radial direction, and, for a region in the furnace radial direction in which the CO gas utilization ratio is greater than or equal to the average value of the CO gas utilization ratio associated with the furnace radial direction, the rate of discharge of the small-size coke to be discharged from the auxiliary hopper is set to be 1.5 to 2 times the rate of discharge employed outside of the region in the furnace radial direction.

16. The method for charging raw materials into a blast furnace according to claim 11, wherein the auxiliary hopper has a hopper body and an outlet, and the auxiliary hopper is provided at a position such that central axes of the hopper body and the outlet coincide with a central axis of a furnace body of the blast furnace.

17. The method for charging raw materials into a blast furnace according to claim 12, wherein the auxiliary hopper has a hopper body and an outlet, and the auxiliary hopper is provided at a position such that central axes of the hopper body and the outlet coincide with a central axis of a furnace body of the blast furnace.

18. The method for charging raw materials into a blast furnace according to claim 13, wherein the auxiliary hopper has a hopper body and an outlet, and the auxiliary hopper is provided at a position such that central axes of the hopper body and the outlet coincide with a central axis of a furnace body of the blast furnace.

19. The method for charging raw materials into a blast furnace according to claim 14, wherein the auxiliary hopper has a hopper body and an outlet, and the auxiliary hopper is provided at a position such that central axes of the hopper body and the outlet coincide with a central axis of a furnace body of the blast furnace.

20. The method for charging raw materials into a blast furnace according to claim 15, wherein the auxiliary hopper has a hopper body and an outlet, and the auxiliary hopper is provided at a position such that central axes of the hopper body and the outlet coincide with a central axis of a furnace body of the blast furnace.

* * * * *